US012799695B2

(12) United States Patent
Wills

(10) Patent No.: US 12,799,695 B2
(45) Date of Patent: Nov. 17, 2026

(54) HEATED AIR BLOWER DEVICE

(71) Applicant: Darren Wills, Alpena, AR (US)

(72) Inventor: Darren Wills, Alpena, AR (US)

( * ) Notice: Subject to any disclaimer, the term of this patent is extended or adjusted under 35 U.S.C. 154(b) by 433 days.

(21) Appl. No.: 18/386,420

(22) Filed: Nov. 2, 2023

(65) Prior Publication Data

US 2025/0146241 A1 May 8, 2025

(51) Int. Cl.
*E01H 5/10* (2006.01)

(52) U.S. Cl.
CPC ..... *E01H 5/106* (2013.01)

(58) Field of Classification Search
CPC ..... A01G 20/47; E01H 5/106
USPC ..... 392/383, 384; 126/271.1
See application file for complete search history.

(56) References Cited

U.S. PATENT DOCUMENTS

| | | | | |
|---|---|---|---|---|
| 7,096,597 | B1 | 8/2006 | Zellous | |
| 9,528,235 | B1 * | 12/2016 | Irving | F24S 10/73 |
| 9,874,398 | B1 | 1/2018 | Wampler | |
| 9,907,234 | B2 | 3/2018 | Poole | |
| D964,672 | S | 9/2022 | Mehra | |
| 2008/0098612 | A1 | 5/2008 | Taylor | |
| 2012/0093490 | A1 | 4/2012 | Steinberg | |
| 2016/0235012 | A1 * | 8/2016 | Fears | A01G 20/47 |
| 2018/0223490 | A1 | 8/2018 | Garcia | |
| 2022/0379850 | A1 * | 12/2022 | Smith | F04D 29/582 |

FOREIGN PATENT DOCUMENTS

| | | |
|---|---|---|
| WO | WO2006075156 | 7/2006 |

* cited by examiner

*Primary Examiner* — Vivek K Shirsat

(57) ABSTRACT

A heated air blower device for thawing a frozen surface includes an air blower which includes a motor and an exhaust manifold each mounted on a backpack that can be worn on a user's back. The motor drives the air blower to urge air outwardly through the exhaust manifold when the motor is turned on and an air nozzle is fluidly attached to the exhaust manifold for receiving the air blown by the air blower. A heating unit is integrated into the air nozzle to heat the air when the heating unit is turned on. In this way the heating unit facilitates the heated air to be directed onto a frozen surface for thawing the frozen surface. Additionally, a solar panel is disposed on the air blower for powering the heating unit.

6 Claims, 6 Drawing Sheets

HEATED AIR BLOWER DEVICE

CROSS-REFERENCE TO RELATED APPLICATIONS

No Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to heated blower devices and more particularly pertains to a new heated blower device for thawing a frozen surface. The device includes a backpack mounted air blower and a heating element integrated into an air nozzle of the backpack mounted air blower to facilitate the air nozzle to blow heated air onto a frozen surface to thaw the frozen surface. The device includes a solar panel for powering the heating element and a heating switch integrated into a handle for actuating and de-actuating the heating element.

(2) Description of Related Art including information disclosed under 37 CFR 1.97 and 1.98

The prior art relates to heated blower devices including a variety of backpack mounted air blowers for blowing air onto a surface and a variety of handheld air blowers that have a heating element for blowing heated air onto a frozen surface and a backpack mounted air blower which has a pair of heating elements integrated into an air nozzle for blowing heated air onto a frozen surface. In no instance does the prior art disclose a backpack mounted air blower which includes a pair of heating elements integrated into an air nozzle and a solar panel mounted to the air blower for powering the pair of heating elements.

BRIEF SUMMARY OF THE INVENTION

An embodiment of the disclosure meets the needs presented above by generally comprising an air blower which includes a motor and an exhaust manifold each mounted on a backpack that can be worn on a user's back. The motor drives the air blower to urge air outwardly through the exhaust manifold when the motor is turned on and an air nozzle is fluidly attached to the exhaust manifold for receiving the air blown by the air blower. A heating unit is integrated into the air nozzle to heat the air when the heating unit is turned on. In this way the heating unit facilitates the heated air to be directed onto a frozen surface for thawing the frozen surface. Additionally, a solar panel is disposed on the air blower for powering the heating unit.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
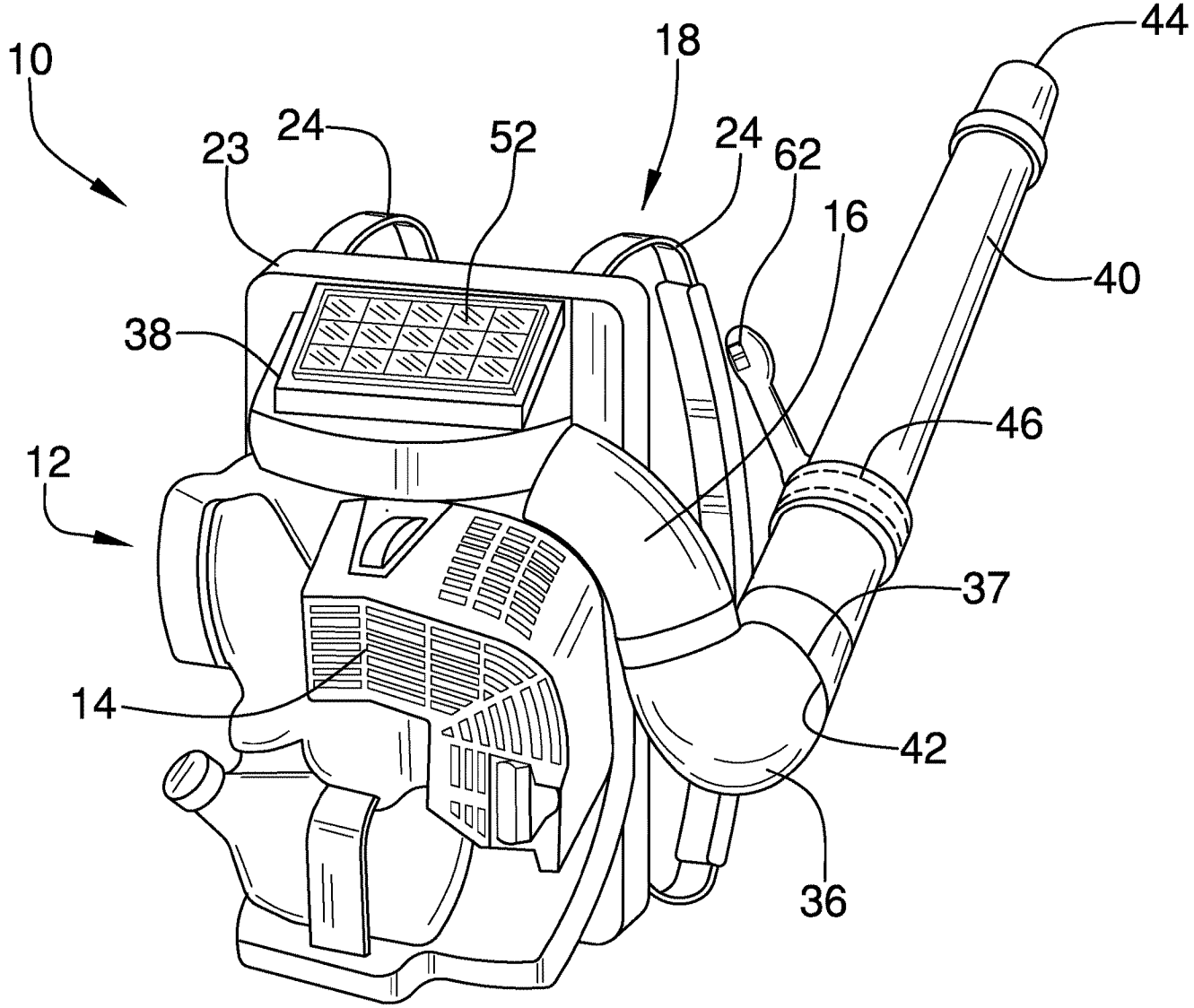
FIG. 1 is a back perspective view of a heated air blower device according to an embodiment of the disclosure.
Figure 2:
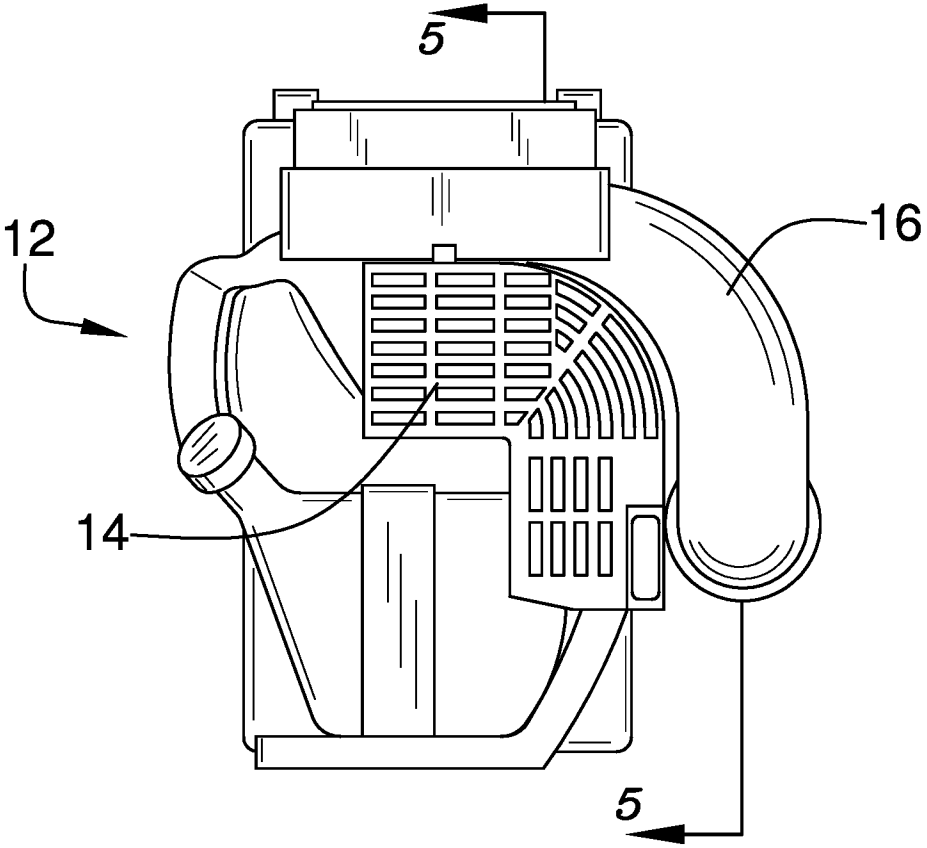
FIG. 2 is a back view of an embodiment of the disclosure.
Figure 3:
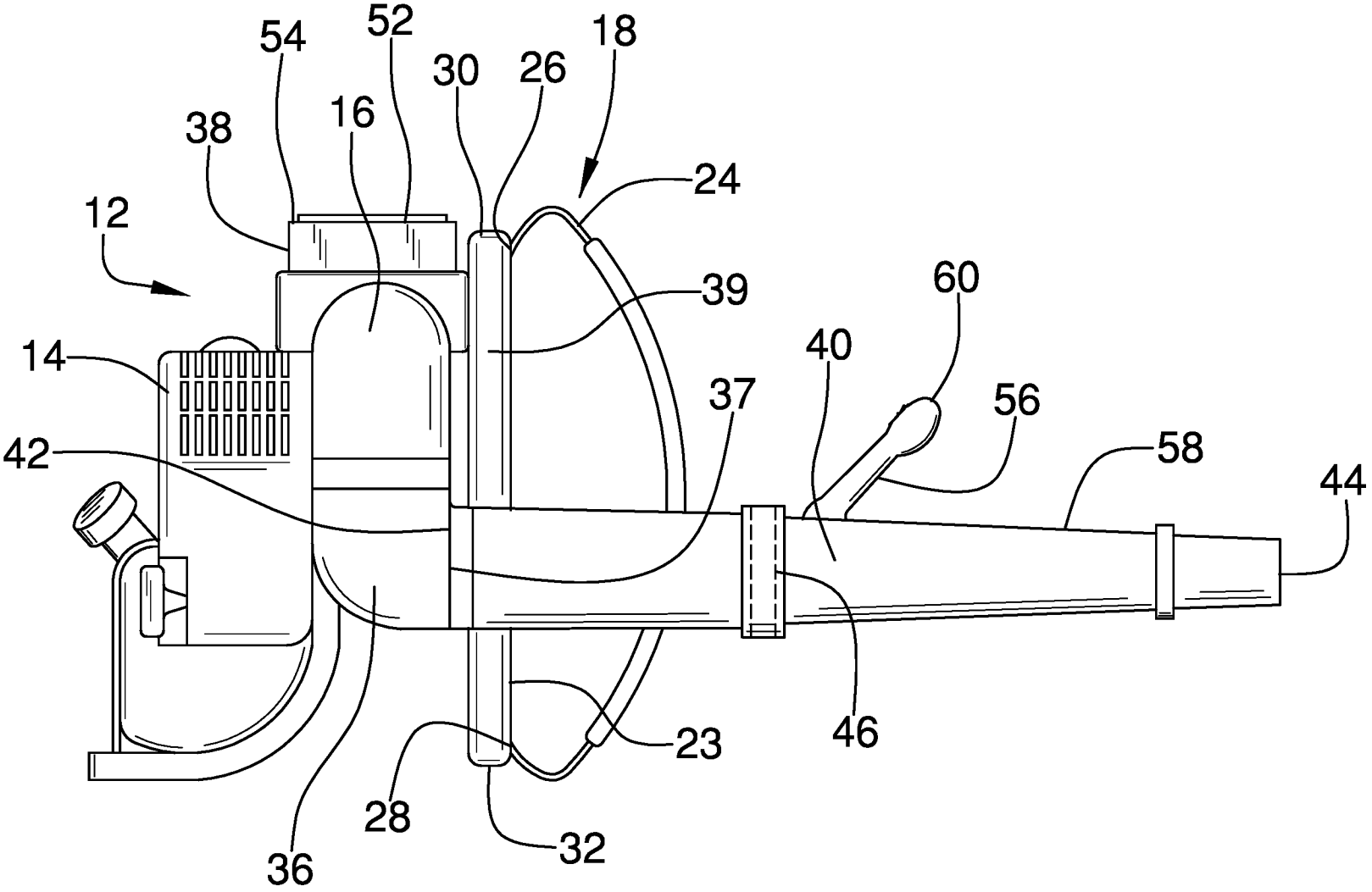
FIG. 3 is a right side view of an embodiment of the disclosure.
Figure 4:
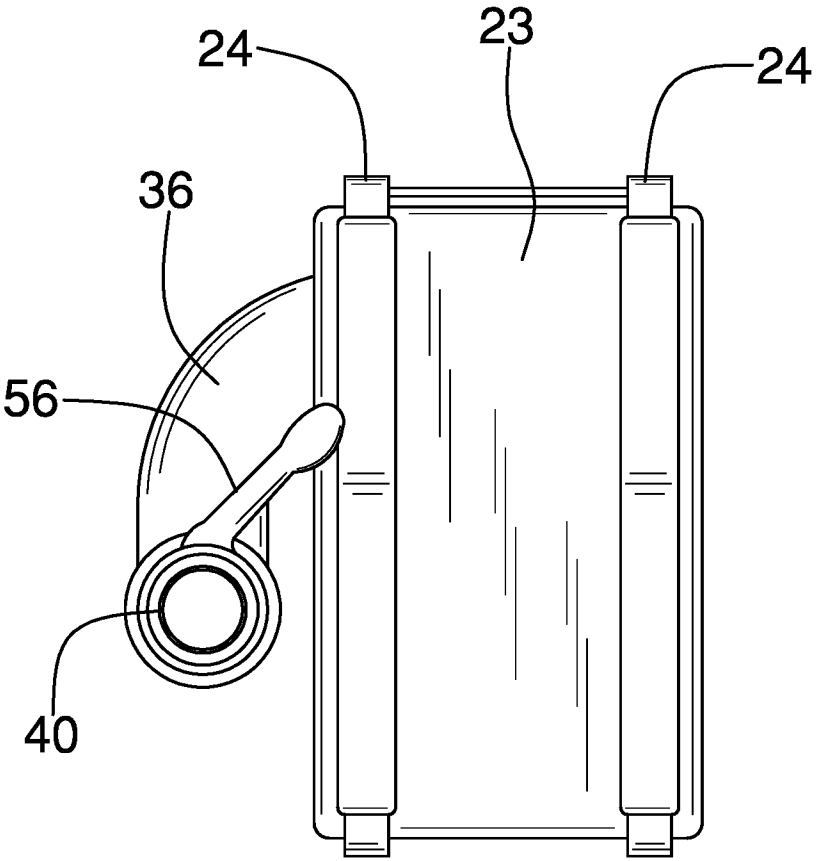
FIG. 4 is a front view of an embodiment of the disclosure.
Figure 5:
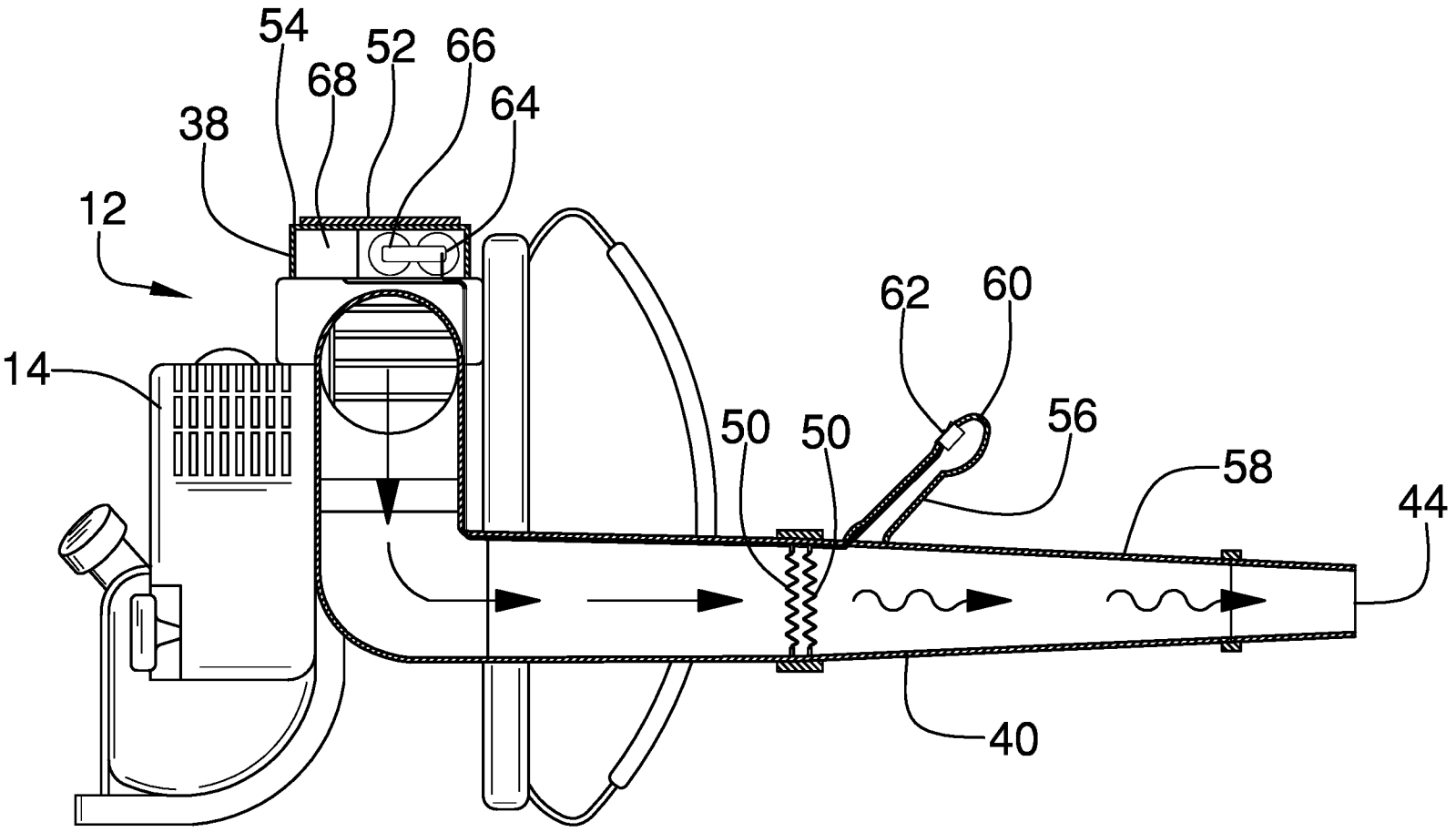
FIG. 5 is a cross sectional view taken along line 5-5 of FIG. 2 of an embodiment of the disclosure.
Figure 6:
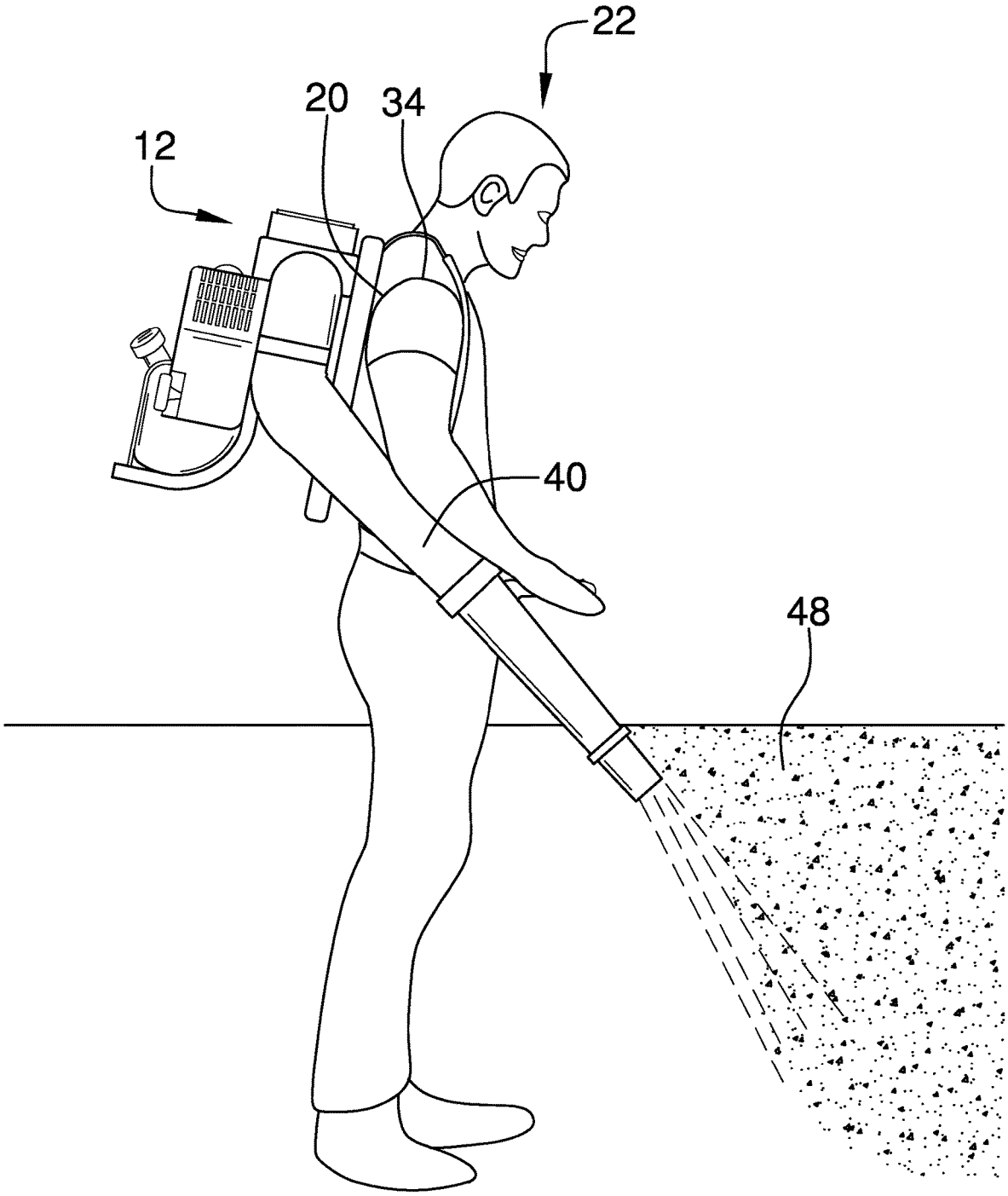
FIG. 6 is a perspective in-use view of an embodiment of the disclosure.

With reference now to the drawings, and in particular to FIGS. 1 through 6 thereof, a new heated blower device embodying the principles and concepts of an embodiment of the disclosure and generally designated by the reference numeral 10 will be described.

As best illustrated in FIGS. 1 through 6, the heated air blower device 10 generally comprises an air blower 12 which includes a motor 14 and an exhaust manifold 16 each being mounted on a backpack 18 such that the air blower 12 can be worn on a back 20 of a user 22. The motor 14 drives the air blower 12 to urge air outwardly through the exhaust manifold 16 when the motor 14 is turned on. The backpack 18 includes a panel 23 to which the motor 14 and the exhaust manifold 16 are attached and a pair of shoulder straps 24 each having a first end 26 and a second end 28 being attached to a respective one of a top edge 30 and a bottom edge 32 of the panel 23. In this way the pair of shoulder straps 24 can be worn over the user's shoulders 34. The motor 14 may comprise a two stroke internal combustion motor or the like and the air blower 12 may include a fan that is driven by the two stroke internal combustion motor.

The exhaust manifold 16 has a pivoting joint 36 that is integrated into the exhaust manifold 16 thereby facilitating an output 37 of the exhaust manifold 16 to be pivoted upwardly and downwardly. Additionally, the air blower 12 includes an electronics housing 38 that is positioned on top of the air blower 12. The pivoting joint 36 curves around a first lateral edge 39 of the panel 23 of the backpack 18 such that the output 37 of the exhaust manifold 16 is directed forwardly from the panel 23. An air nozzle 40 is fluidly attached to the exhaust manifold 16 for receiving the air blown by the air blower 12. The air nozzle 40 has a coupled end 42 that is coupled to the output 37 of the exhaust manifold 16. In this way the air nozzle 40 can facilitate the user 22 to point the air nozzle 40 in a variety of directions for directing the air to flow in a chosen direction. The air nozzle 40 tapers between the coupled end 42 and a free end 44 of the air nozzle 40 thereby facilitating the air nozzle 40 to increase a velocity of the air flowing outwardly from the free end 44.

A heating unit 46 is integrated into the air nozzle 40 such that the heating unit 46 is in thermal communication with the air being blown through the air nozzle 40. In this way the heating unit 46 can heat the air when the heating unit 46 is turned on to facilitate the heated air to be directed onto a frozen surface 48 for thawing the frozen surface 48. The frozen surface 48 may be a sidewalk, a driveway, a roof of a building or any other surface that is exposed to freezing temperatures and which requires routine clearing of ice and snow. The heating unit 46 comprises a pair of heating elements 50 and each of the pair of heating elements 50 is positioned between the coupled end 42 and the free end 44 of the air nozzle 40. Each of the pair of heating elements 50 may comprise an electric heating element or the like which may have an operational temperature ranging between approximately 200.0 degrees Fahrenheit and 300.0 degrees Fahrenheit.

A solar panel 52 is disposed on the air blower 12 to facilitate the solar panel 52 to be exposed to sunlight and the solar panel 52 is in communication with the heating unit 46 for powering the heating unit 46. The solar panel 52 is positioned on a top side 54 of the electronics housing 38 to facilitate the solar panel 52 to be exposed to a maximum intensity of sunlight when the user 22 is wearing the backpack 18. Furthermore, the solar panel 52 is oriented at a downward angle on the top side 54 of the electronics housing 38 to facilitate the solar panel 52 to capture sunlight at an optimal angle when the user 22 is wearing the backpack 18.

A handle 56 is attached to the air nozzle 40 to facilitate the handle 56 to be gripped by the user 22 for pointing the air nozzle 40. The handle 56 is attached to and angles forwardly from an outer wall 58 of the air nozzle 40 having the handle 56 being centrally positioned between the coupled end 42 and the free end 44. Additionally, as is most clearly shown in FIG. 4, the handle 56 angles laterally toward the user 22 to enhance access to the handle 56. The handle 56 has a distal end 60 with respect to the outer wall 58 and the handle 56 curves outwardly adjacent to the distal end 60. Thus, the distal end 60 is bulbous to enhance being gripped by the user 22. A heater switch 62 is movably integrated into the handle 56 to be engaged by the user 22. The heater switch 62 is electrically coupled to each of the pair of heating elements 50 for actuating and de-actuating the pair of heating elements 50.

A power supply 64 is integrated into the air blower 12 and the power supply 64 is electrically coupled to each of the pair of heating elements 50. The power supply 64 comprises a rechargeable battery 66 that is positioned within the electronics housing 38 and the rechargeable battery 66 is electrically coupled to each of the pair of heating elements 50. The power supply 64 includes a charging processor 68 that is positioned within the electronics housing 38. The charging processor 68 is electrically coupled between the solar panel 52 and the rechargeable battery 66 thereby facilitating the charging processor 68 to actuate the solar panel 52 to charge the rechargeable battery 66.

In use, the motor 14 is started and the backpack 18 is worn on the user's back 20 to facilitate the user 22 to grip the handle 56 and point the air nozzle 40 in a desired direction. In this way the air blower 12 can be employed for blowing debris, such as leaves for example, on a surface for subsequent collection and disposal. The heater switch 62 can be engaged to turn on the pair of heating elements 50. In this way the air blower 12 can blow heated air for thawing a frozen surface 48, such as an icy sidewalk for example. Thus, the air blower 12 can serve dual function for either blowing debris or the thawing the frozen surface 48.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A heated air blower device which is wearable in the convention of a backpack for blowing heated air onto a frozen surface for thawing the frozen surface, said device comprising:

an air blower comprising a motor and an exhaust manifold each being mounted on a backpack wherein said air blower is configured to be worn on a user's back, said motor driving said air blower to urge air outwardly through said exhaust manifold when said motor is turned on;

an air nozzle being fluidly attached to said exhaust manifold for receiving the air blown by said air blower;

a heating unit being integrated into said air nozzle such that said heating unit is in thermal communication with the air being blown through said air nozzle thereby facilitating said heating unit to heat the air when said heating unit is turned on wherein said heating unit is configured to facilitate the heated air to be directed onto a frozen surface for thawing the frozen surface;

a solar panel being disposed on said air blower wherein said solar panel is configured to be exposed to sunlight, said solar panel being in communication with said heating unit for powering said heating unit;

a handle being attached to said air nozzle wherein said handle is configured to be gripped by the user for pointing said air nozzle;

a heater switch being movably integrated into said handle wherein said heater switch is configured to be engaged by the user;

wherein said heating unit comprises a pair of heating elements, each of said pair of heating elements being positioned between a coupled end and a free end of said air nozzle;

wherein said handle is attached to and an angling forwardly from an outer wall of said air nozzle having said handle being centrally positioned between said coupled end of said air nozzle and said free end of said air nozzle, said handle having a distal end with respect to said outer wall, said handle curving outwardly adjacent to said distal end such that said distal end is bulbous wherein said distal end is configured to enhance being gripped by the user; and wherein said heater switch is electrically coupled to each of said pair of heating elements for actuating and de-actuating said pair of heating elements.

2. The device according to claim 1, wherein:

said backpack includes a panel to which said motor and said exhaust manifold are attached and a pair of shoulder straps each having a first end and a second end being attached to a respective one of a top edge and a bottom edge of said panel wherein said pair of shoulder straps is configured to be worn over the user's shoulders;

said exhaust manifold has a pivoting joint being integrated into said exhaust manifold thereby facilitating an output of said exhaust manifold to be pivoted upwardly and downwardly; and said air blower includes an electronics housing being positioned on top of said air blower.

3. The device according to claim 2, wherein said air nozzle has a coupled end being coupled to said output of said exhaust manifold wherein said air nozzle is configured to facilitate the user to point said air nozzle in a variety of directions for directing the air to flow in a chosen direction, said air nozzle tapering between said coupled end and a free end of said air nozzle thereby facilitating said air nozzle to increase a velocity of the air flowing outwardly from said free end.

4. The device according to claim 1, wherein:

said air blower includes an electronics housing being positioned on top of said air blower;

said solar panel is positioned on a top side of said electronics housing wherein said solar panel is configured to be exposed to a maximum intensity of sunlight; and said solar panel is oriented at a downward angle on said top side of said electronics housing wherein said solar panel is configured to capture sunlight at an optimal angle.

5. The device according to claim 1, further comprising a power supply being integrated into said air blower, said power supply being electrically coupled to each of said pair of heating elements, said power supply comprising:

a rechargeable battery being positioned within said electronics housing, said rechargeable battery being electrically coupled to each of said pair of heating elements; and a charging processor being positioned within said electronics housing, said charging processor being electrically coupled between said solar panel and said rechargeable battery thereby facilitating said charging processor to actuate said solar panel to charge said rechargeable battery.

6. A heated air blower device which is wearable in the convention of a backpack for blowing heated air onto a frozen surface for thawing the frozen surface, said device comprising:

an air blower comprising a motor and an exhaust manifold each being mounted on a backpack wherein said air blower is configured to be worn on a user's back, said motor driving said air blower to urge air outwardly through said exhaust manifold when said motor is turned on, said backpack including a panel to which said motor and said exhaust manifold are attached and a pair of shoulder straps each having a first end and a second end being attached to a respective one of a top edge and a bottom edge of said panel wherein said pair of shoulder straps is configured to be worn over the user's shoulders, said exhaust manifold having a pivoting joint being integrated into said exhaust manifold thereby facilitating an output of said exhaust manifold to be pivoted upwardly and downwardly, said air blower including an electronics housing being positioned on top of said air blower;

an air nozzle being fluidly attached to said exhaust manifold for receiving the air blown by said air blower, said air nozzle having a coupled end being coupled to said output of said exhaust manifold wherein said air nozzle is configured to facilitate the user to point said air nozzle in a variety of directions for directing the air to flow in a chosen direction, said air nozzle tapering between said coupled end and a free end of said air nozzle thereby facilitating said air nozzle to increase a velocity of the air flowing outwardly from said free end;

a heating unit being integrated into said air nozzle such that said heating unit is in thermal communication with the air being blown through said air nozzle thereby facilitating said heating unit to heat the air when said heating unit is turned on wherein said heating unit is configured to facilitate the heated air to be directed onto a frozen surface for thawing the frozen surface, said heating unit comprising a pair of heating elements, each of said pair of heating elements being positioned between said coupled end and said free end of said air nozzle;

a solar panel being disposed on said air blower wherein said solar panel is configured to be exposed to sunlight, said solar panel being in communication with said heating unit for powering said heating unit, said solar panel being positioned on a top side of said electronics housing wherein said solar panel is configured to be exposed to a maximum intensity of sunlight, said solar panel being oriented at a downward angle on said top side of said electronics housing wherein said solar panel is configured to capture sunlight at an optimal angle;

a handle being attached to said air nozzle wherein said handle is configured to be gripped by the user for pointing said air nozzle, said handle being attached to and an angling forwardly from an outer wall of said air nozzle having said handle being centrally positioned between said coupled end and said free end, said handle having a distal end with respect to said outer wall, said handle curving outwardly adjacent to said distal end such that said distal end is bulbous wherein said distal end is configured to enhance being gripped by the user;

a heater switch being movably integrated into said handle wherein said heater switch is configured to be engaged by the user, said heater switch being electrically coupled to each of said pair of heating elements for actuating and de-actuating said pair of heating elements; and a power supply being integrated into said air blower, said power supply being electrically coupled to each of said pair of heating elements, said power supply comprising:

a rechargeable battery being positioned within said electronics housing, said rechargeable battery being electrically coupled to each of said pair of heating elements; and a charging processor being positioned within said electronics housing, said charging processor being electrically coupled between said solar panel and said rechargeable battery thereby facilitating said charging processor to actuate said solar panel to charge said rechargeable battery.

* * * * *